US011691376B2

(12) United States Patent
Nitta

(10) Patent No.: US 11,691,376 B2
(45) Date of Patent: Jul. 4, 2023

(54) SHEET HUMIDIFYING DEVICE, METHOD, AND CARDBOARD SHEET MANUFACTURING DEVICE

(71) Applicant: MITSUBISHI HEAVY INDUSTRIES MACHINERY SYSTEMS, LTD., Hyogo (JP)

(72) Inventor: Takashi Nitta, Kobe (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 17/421,935

(22) PCT Filed: Dec. 11, 2019

(86) PCT No.: PCT/JP2019/048573

§ 371 (c)(1),
(2) Date: Jul. 9, 2021

(87) PCT Pub. No.: WO2020/149059

PCT Pub. Date: Jul. 23, 2020

(65) Prior Publication Data

US 2022/0118730 A1 Apr. 21, 2022

(30) Foreign Application Priority Data

Jan. 17, 2019 (JP) ..... 2019-006328

(51) Int. Cl.
*B31F 1/36* (2006.01)

(52) U.S. Cl.
CPC ..... *B31F 1/36* (2013.01)

(58) Field of Classification Search
CPC ..... B31F 1/36
USPC ..... 493/470
See application file for complete search history.

(56) References Cited

U.S. PATENT DOCUMENTS 3,379,593 A * 4/1968 Maze ..... B31F 1/2872 156/278
4,419,173 A * 12/1983 Akiyama ..... B31F 1/285 156/551
5,156,714 A * 10/1992 Thomas ..... B31F 1/285 156/472
5,921,907 A * 7/1999 Beierlorzer ..... G01N 33/84 493/357

(Continued)

FOREIGN PATENT DOCUMENTS

EP 3357679 A1 8/2018
JP 2006315393 A 11/2006

(Continued)

OTHER PUBLICATIONS

Extended European Search Report of European Application No. 19910362.3 dated Jan. 17, 2022; 6pp.

*Primary Examiner* — Chelsea E Stinson
(74) *Attorney, Agent, or Firm* — Hauptman Ham, LLP

(57) ABSTRACT

A sheet humidifying device, a method, and a cardboard sheet manufacturing device are provided with: a pre-heating roll that has an outer peripheral surface on which a corrugating medium is wrapped; and a humidified water jetting device that jets humidified water onto the outer peripheral surface of the pre-heating roll on which the corrugating medium has not been wrapped.

9 Claims, 4 Drawing Sheets

(56) References Cited

U.S. PATENT DOCUMENTS

| | | | | |
|---|---|---|---|---|
| 6,171,427 | B1 * | 1/2001 | Hess | B31F 1/2872 156/472 |
| 6,280,574 | B1 * | 8/2001 | Bauer | D21G 1/0093 162/266 |
| 8,398,802 | B2 | 3/2013 | Kohler | |
| 2010/0181015 | A1 | 7/2010 | Kohler | |
| 2012/0024476 | A1 * | 2/2012 | Ohira | B31F 1/2813 156/356 |
| 2015/0306837 | A1 * | 10/2015 | Krumm | B31F 1/36 156/210 |
| 2020/0247081 | A1 | 8/2020 | Harada et al. | |

FOREIGN PATENT DOCUMENTS

| | | | |
|---|---|---|---|
| JP | 2008073906 | A | 4/2008 |
| JP | 2010241079 | A | 10/2010 |
| JP | 2012515673 | A | 7/2012 |
| WO | 2017082012 | A1 | 5/2017 |

* cited by examiner

SHEET HUMIDIFYING DEVICE, METHOD, AND CARDBOARD SHEET MANUFACTURING DEVICE

RELATED APPLICATIONS

The present application is a National Phase of International Application Number PCT/JP2019/048573 filed Dec. 11, 2019 and claims priority of Japanese Application Number 2019-006328 filed Jan. 17, 2019.

TECHNICAL FIELD

The present invention relates to a sheet humidifying device and method for humidifying sheets such as a bottom liner, a medium, and a top liner which are used for manufacturing a cardboard sheet, and a cardboard sheet-manufacturing apparatus to which the sheet humidifying device is applicable.

BACKGROUND ART

A corrugating machine as a cardboard sheet-manufacturing apparatus includes a single facer that forms a single-faced cardboard sheet and a double facer that forms a double-faced cardboard sheet by bonding a bottom liner to the single-faced cardboard sheet. In the single facer, a medium is processed into a corrugated shape, and a top liner is bonded to form the single-faced cardboard sheet. In the double facer, the bottom liner is bonded to the single-faced cardboard sheet to form the double-faced cardboard sheet. The continuous double-faced cardboard sheet manufactured by the double facer is cut to have a predetermined width by a slitter scorer, and is cut to have a predetermined length by a cutoff, thereby manufacturing a plate-shaped cardboard sheet.

For example, in the corrugating machine, in the single facer, the top liner heated by a preheater is transferred to a nip portion between a pressurizing belt and an upper corrugating roll. In contrast, the medium heated by the preheater is corrugated in a meshing portion between the upper corrugating roll and a lower corrugating roll. After an adhesive is applied to a top of each stage of the medium, the medium is transferred to the nip portion. Then, in the nip portion, the medium is bonded to the top liner to form the single-faced cardboard sheet.

In this case, the top liner and the medium are heated by the preheater so that moisture content is evaporated and reduced. Therefore, it is necessary to adjust a moisture content amount to an optimum amount by humidifying the top liner and the medium in front of and behind the preheater. As a sheet humidifying device in the related art, PTLs 1 and 2 disclose the following devices. In a humidifying device disclosed in PTL 1, a liquid application roller and a chamber are disposed on a downstream side of the preheater, and heating water of the chamber is applied to the bottom liner by rotating the liquid application roller. In a cardboard sheet-manufacturing apparatus disclosed in PTL 2, a suction roll and steam blowing means are disposed on an upstream side of a preheating roll. When the suction roll is rotated to convey the sheet, the steam blowing means blows steam toward the sheet wrapped around the suction roll.

CITATION LIST

Patent Literature

[PTL 1] International Publication No. WO2017-082012

[PTL 2] Japanese Unexamined Patent Application Publication No. 2006-315393

SUMMARY OF INVENTION

Technical Problem

In the humidifying device disclosed in PTL 1, the heating water of the chamber is applied to the bottom liner via the liquid application roller. Therefore, in addition to the preheater, the chamber and the liquid application roller are required. The device increases in size, a large disposition space is required, and manufacturing costs inevitably increase. In the device disclosed in PTL 2, the steam is blown to the sheet wrapped around the suction roll. Therefore, in addition to the preheating roll, the suction roll and the steam blowing means are required. The device increases in size, a large disposition space is required, and manufacturing costs inevitably increase.

The present invention is made to solve the above-described problems, and an object thereof is to provide a sheet humidifying device and method, and a cardboard sheet-manufacturing apparatus which properly adjust a moisture content amount of a sheet and achieves a simplified device.

Solution to Problem

In order to achieve the above-described object, there is provided a sheet humidifying device including a heating roll having an outer peripheral surface around which a sheet is wrapped, and a humidifying water ejection device that ejects humidifying water to the outer peripheral surface around which the sheet is not wrapped in the heating roll.

Therefore, the sheet is heated by being wrapped around the outer peripheral surface of the heating roll. In this case, when the humidifying water ejection device ejects the humidifying water toward the heating roll, the humidifying water adheres to the outer peripheral surface of the heating roll. In this case, a portion of the humidifying water adhering to the outer peripheral surface of the heating roll is heated to a high temperature, and is supplied to the sheet wrapped via the outer peripheral surface of the heating roll. A portion of the humidifying water comes into contact with the outer peripheral surface of the heating roll. In this manner, the portion of the humidifying water is vaporized into steam, and the sheet is humidified. That is, the sheet is heated and humidified at the same time. Accordingly, a moisture content amount of the sheet can be properly adjusted. In addition, a simplified device can be achieved since a sheet humidifying roll is not separately required.

In the sheet humidifying device of the present invention, the sheet may come into contact with the outer peripheral surface of the heating roll from a lower side of the heating roll in a vertical direction, may be wrapped around the outer peripheral surface of the heating roll by a predetermined length in a circumferential direction, and thereafter, may be conveyed to be separated from the outer peripheral surface on an upper side of the heating roll in the vertical direction. The humidifying water ejection device may eject the humidifying water to the outer peripheral surface of the heating roll, from below the sheet separated from the heating roll.

Therefore, the humidifying water ejection device ejects the humidifying water to the outer peripheral surface of the heating roll, from below the sheet separated from the heating roll. Accordingly, the humidifying water reaches the outer peripheral surface of the heating roll, and comes into contact with the outer peripheral surface of the heating roll so that the humidifying water is vaporized into the steam. Therefore, the sheet is humidified from the outer peripheral surface of the heating roll, and is also humidified by the steam even after being separated from the outer peripheral surface of the heating roll. Accordingly, the amount for humidifying the sheet can be sufficiently secured.

The sheet humidifying device of the present invention may further include a sheet wrap angle adjustment roll supported to be movable along a circumferential direction in a predetermined movement range set in advance, on an outer peripheral side of the heating roll, and adjusting a sheet contact position for coming into contact with the outer peripheral surface of the heating roll. The humidifying water ejection device may be disposed outside the predetermined movement range.

Therefore, the humidifying water ejection device is disposed outside the predetermined movement range in which the sheet wrap angle adjustment roll moves. Accordingly, the humidifying water can be ejected to the heating roll without disturbing movement adjustment work of the sheet wrap angle adjustment roll.

In the sheet humidifying device of the present invention, the humidifying water ejection device may eject the humidifying water to the outer peripheral surface of the heating roll, from above the sheet wrap angle adjustment roll.

Therefore, the humidifying water ejection device ejects the humidifying water to the outer peripheral surface of the heating roll, from above the sheet wrap angle adjustment roll. Accordingly, a position of the humidifying water reaching the heating roll is brought closer to a position where the sheet comes into contact with the heating roll. Therefore, the humidifying water from the humidifying water ejection device can be efficiently supplied to the sheet.

In the sheet humidifying device of the present invention, as the humidifying water, the humidifying water ejection device may eject high-pressure hot water having a temperature of 100° C. or higher toward the outer peripheral surface of the heating roll.

Therefore, a portion of the high-pressure hot water having the temperature of 100° C. or higher ejected from the humidifying water ejection device is vaporized into the steam in the atmosphere. Accordingly, the sheet can be efficiently humidified not only by the humidifying water but also by the steam.

In the sheet humidifying device of the present invention, the heating roll may be capable of heating the sheet wrapped around the outer peripheral surface by supplying the steam into the heating roll. As the humidifying water, the humidifying water ejection device may eject condensed water of the steam discharged from the heating roll, toward the outer peripheral surface of the heating roll.

Therefore, as the humidifying water, the humidifying water ejection device ejects the condensed water of the steam discharged from the heating roll. Accordingly, it is not necessary to separately prepare the humidifying water, and the condensed water can be effectively utilized. Therefore, a cost increase can be suppressed.

In the sheet humidifying device of the present invention, the humidifying water ejection device may have an ejection amount adjustment device that adjusts an ejection amount of the humidifying water ejected to the outer peripheral surface of the heating roll.

Therefore, the ejection amount adjustment device adjusts the ejection amount of the humidifying water ejected to the outer peripheral surface of the heating roll. Accordingly, a proper amount of the humidifying water can be ejected in accordance with a water content of the sheet to be used.

In the sheet humidifying device of the present invention, the humidifying water ejection device may have a water supply pipe disposed along an axial direction of the heating roll at a position separated from the outer peripheral surface of the heating roll, and a plurality of nozzles provided at a predetermined interval in a longitudinal direction of the water supply pipe, and ejecting the humidifying water. The humidifying water ejection device may be provided with a leveling blade that comes into contact with the outer peripheral surface of the heating roll.

Therefore, when humidifying water is ejected to the outer peripheral surface of the heating roll from the plurality of nozzles in the water supply pipe, the leveling blade comes into contact with the outer peripheral surface of the heating roll. Accordingly, a film thickness of the humidifying water adhering to the outer peripheral surface of the heating roll can be adjusted to be uniform in the axial direction of the heating roll.

In addition, according to the present invention, there is provided a sheet humidifying method including a step of heating a sheet by wrapping the sheet around an outer peripheral surface of a heating roll, and a step of ejecting humidifying water having a temperature of 100° C. or higher to the outer peripheral surface of the heating roll around which the sheet is not wrapped.

Therefore, when humidifying water having the temperature of 100° C. or higher is ejected to the outer peripheral surface of the heating roll, a portion of the humidifying water is vaporized into the steam, and the rest adheres to the outer peripheral surface of the heating roll. In this case, a portion of the humidifying water adhering to the outer peripheral surface of the heating roll is heated to a high temperature, and is supplied to the sheet wrapped via the outer peripheral surface of the heating roll. A portion of the humidifying water comes into contact with the outer peripheral surface of the heating roll. In this manner, the portion of the humidifying water is vaporized into the steam, the sheet is humidified, and is heated by the heating roll. That is, the sheet is heated and humidified at the same time. Accordingly, a moisture content amount of the sheet can be properly adjusted.

In addition, according to the present invention, there is provided a cardboard sheet-manufacturing apparatus including a single facer that manufactures a single-faced cardboard sheet by bonding a second liner to a corrugated medium, a double facer that manufactures a cardboard sheet by bonding a first liner to the medium side in the single-faced cardboard sheet, and the sheet humidifying device, which humidifies at least one of the medium, the second liner, and the first liner.

Therefore, the single facer manufactures the single-faced cardboard sheet by bonding the second liner to the corrugated medium, and the double facer manufactures the cardboard sheet by bonding the first liner to the medium side in the single-faced cardboard sheet. In this case, the sheet humidifying device heats the sheet by wrapping the medium, the second liner, and the first liner around the outer peripheral surface of the heating roll, and the sheet is humidified by the humidifying water adhering to the heating roll. That is, the medium, the second liner, and the first liner are heated and humidified at the same time. Accordingly, the moisture content amount can be properly adjusted. In addition, a simplified device can be achieved since a sheet humidifying roll is not separately required.

Advantageous Effects of Invention

According to the sheet humidifying device and method, and the cardboard sheet-manufacturing apparatus in the present invention, the moisture content amount of the sheet can be properly adjusted, and the simplified device can be achieved.

DESCRIPTION OF EMBODIMENTS

Hereinafter, preferred embodiments of the sheet humidifying device and method, and the cardboard sheet-manufacturing apparatus in the present invention will be described in detail with reference to the accompanying drawings. The present invention is not limited to the embodiments. In a case where there are a plurality of the embodiments, the present invention also includes a configuration adopted by combining the respective embodiments with each other.

Figure 1:
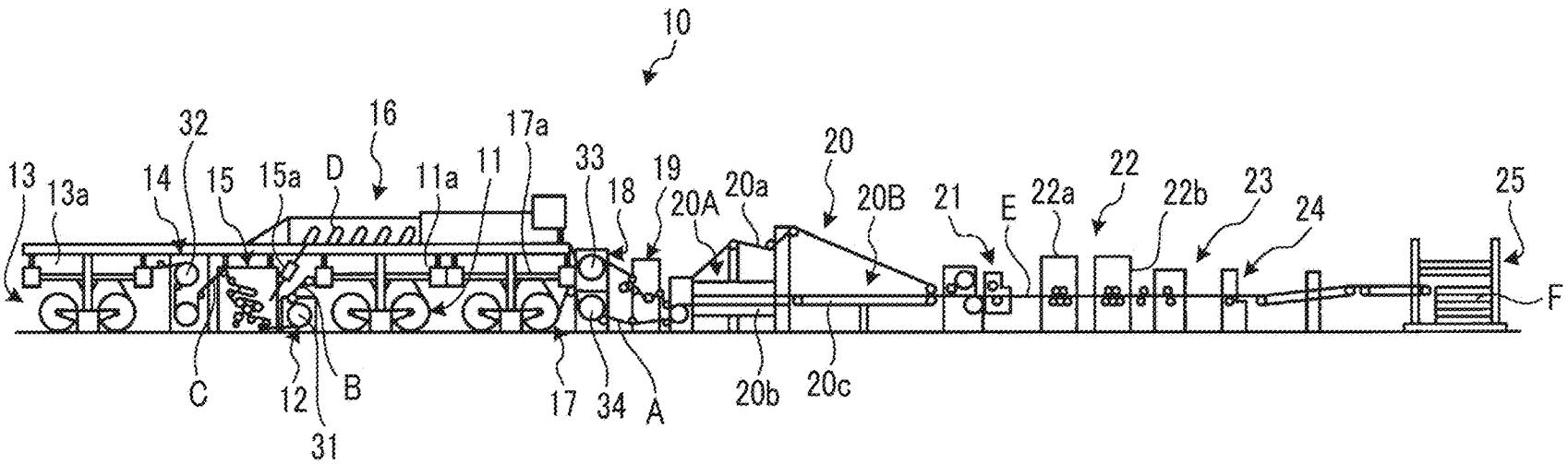
FIG. 1 is a schematic view illustrating a corrugating machine serving as a cardboard sheet-manufacturing apparatus of the present embodiment.

FIG. 1 is a schematic view illustrating a corrugating machine serving as a cardboard sheet-manufacturing apparatus of the present embodiment.

As illustrated in FIG. 1, a corrugating machine 10 serving as a cardboard sheet-manufacturing apparatus manufactures a single-faced cardboard sheet D by bonding a top liner (second liner) C to a corrugated medium B. A bottom liner (first liner) A is bonded to the medium B side in the manufactured single-faced cardboard sheet D to form a double-faced cardboard sheet E. The continuous double-faced cardboard sheet E is cut to have a predetermined length, thereby manufacturing a sheet-shaped double-faced cardboard sheet F.

The corrugating machine 10 includes a mill roll stand 11 and a preheater 12 of the medium B, a mill roll stand 13 and a preheater 14 of the top liner C, a single facer 15, a bridge 16, a mill roll stand 17 and a preheater 18 of the bottom liner A, a glue machine 19, a double facer 20, a rotary shear 21, a slitter scorer 22, a cutoff 23, a defective sheet rejecting device 24, and a stacker 25.

In the mill roll stand 11, a roll paper around which each medium B is wrapped in a roll shape is mounted on both sides, and a splicer 11*a* for splicing the roll paper is provided above the mill roll stand 11. When a remaining amount of one roll paper is small, the splicer 11*a* splices the other roll paper. Accordingly, the medium B can be continuously fed toward the downstream side from the mill roll stand 11.

In the mill roll stand 13, a roll paper around which each top liner C is wrapped in a roll shape is mounted on both sides, and a splicer 13*a* for splicing the roll paper is provided above the mill roll stand 13. When a remaining amount of one roll paper is small, the splicer 13*a* splices the other roll paper. Accordingly, the top liner C can be continuously fed toward the downstream side from the mill roll stand 13.

The preheaters 12 and 14 respectively preheat the medium B and the top liner C. The preheaters 12 and 14 have preheating rolls (heating rolls) 31 and 32 into which steam is supplied, and heat the medium B and the top liner C to have a predetermined temperature by transferring the medium B and the top liner C continuously fed out from the mill roll stands 11 and 13 while heating the medium B and the top liner C by the preheating rolls 31 and 32.

In the single facer 15, the medium B heated by the preheater 12 is corrugated, and thereafter, an adhesive is applied to a top of each stage of the medium B. The top liner C heated by the preheater 14 is bonded to the medium B to form the single-faced cardboard sheet D. In the single facer 15, a pick-up conveyor 15*a* is provided obliquely upward on the downstream side in a transfer direction. The pick-up conveyor 15*a* is configured to include a pair of endless belts, nips the single-faced cardboard sheet D formed by the single facer 15, and transfers the single-faced cardboard sheet D to the bridge 16. The bridge 16 temporarily retains the single-faced cardboard sheet D in order to absorb a speed difference between the single facer 15 and the double facer 20.

In the mill roll stand 17, a roll paper around which each bottom liner A is wrapped in a roll shape is mounted on both sides, and a splicer 17*a* for splicing the roll paper is provided above the mill roll stand 17. When a remaining amount of one roll paper is small, the splicer 17*a* splices the other roll paper. Accordingly, the bottom liner A can be continuously fed toward the downstream side from the mill roll stand 17.

The preheater 18 preheats each of the single-faced cardboard sheet D and the bottom liner A. The preheater 18 has preheating rolls 33 and 34 into which the steam is supplied, and heats the single-faced cardboard sheet D and the bottom liner A to have a predetermined temperature by transferring the single-faced cardboard sheet D and the bottom liner A continuously fed out from the mill roll stand 17 while heating the single-faced cardboard sheet D and the bottom liner A by the preheating rolls 33 and 34.

The glue machine 19 has an adhesive equipment. The single-faced cardboard sheet D heated by the preheating roll 33 is intermediately guided into the glue machine 19, and an adhesive is applied to each top of the stage of the medium B when the single-faced cardboard sheet D passes between a rider roll and an adhesive applicator roll. The single-faced cardboard sheet D subjected to adhesive application by the glue machine 19 is transferred to the double facer 20. In addition, the bottom liner A heated by the preheating roll 34 is also transferred to the double facer 20 through the inside of the glue machine 19.

The double facer 20 is divided into a heating section 20A on the upstream side and a cooling section 20B on the downstream side along a traveling line of the single-faced cardboard sheet D and the bottom liner A. The single-faced cardboard sheet D subjected to adhesive application by the glue machine 19 is loaded between a pressurizing belt 20*a* and a heating plate 20*b* in the heating section 20A, and the bottom liner A is loaded between the pressurizing belt 20*a* and the heating plate 20*b* to overlap the medium B side of the single-faced cardboard sheet D. The single-faced cardboard sheet D and the bottom liner A are loaded between the pressurizing belt 20*a* and the heating plate 20*b*, and thereafter, are integrally transferred toward the cooling section 20B in a vertically overlapping state. When transferred, the single-faced cardboard sheet D and the bottom liner A are heated while being pressurized. In this manner, both are bonded to each other to form the continuous double-faced cardboard sheet E. The double-faced cardboard sheet E is naturally cooled when transferred while being nipped between the pressurizing belt 20*a* and a transfer belt 20*c* in the cooling section 20B, and is transferred to the rotary shear 21.

The rotary shear 21 entirely or partially cuts a width of the double-faced cardboard sheet E in a width direction until bonding is stabilized at an initial stage of an operation. The slitter scorer 22 cuts the wide double-faced cardboard sheet E along a transfer direction to have a predetermined width, and processes a ruled line extending in the transfer direction. The slitter scorer 22 is configured to include a first slitter scorer unit 22*a* and a second slitter scorer unit 22*b* which have substantially the same structure arrayed along the transfer direction of the double-faced cardboard sheet E. The first slitter scorer unit 22*a* and the second slitter scorer unit 22*b* have a plurality of sets of upper ruled line rolls and lower ruled line rolls which are disposed to face each other across the double-faced cardboard sheet E in the width direction, and have a plurality of sets of slitter knives disposed on the lower side of the double-faced cardboard sheet E in the width direction.

The cutoff 23 cuts the double-faced cardboard sheet E cut in the transfer direction by the slitter scorer 22 along the width direction, thereby forming the plate-shaped double-faced cardboard sheet F having a predetermined length. The defective sheet rejecting device 24 discharges the double-faced cardboard sheet F determined to be a defective sheet by a defective sheet detection device from a transfer line. The stacker 25 stacks the double-faced cardboard sheets F having good quality, and discharges the double-faced cardboard sheets F to the outside of the machine as a product.

Figure 2:
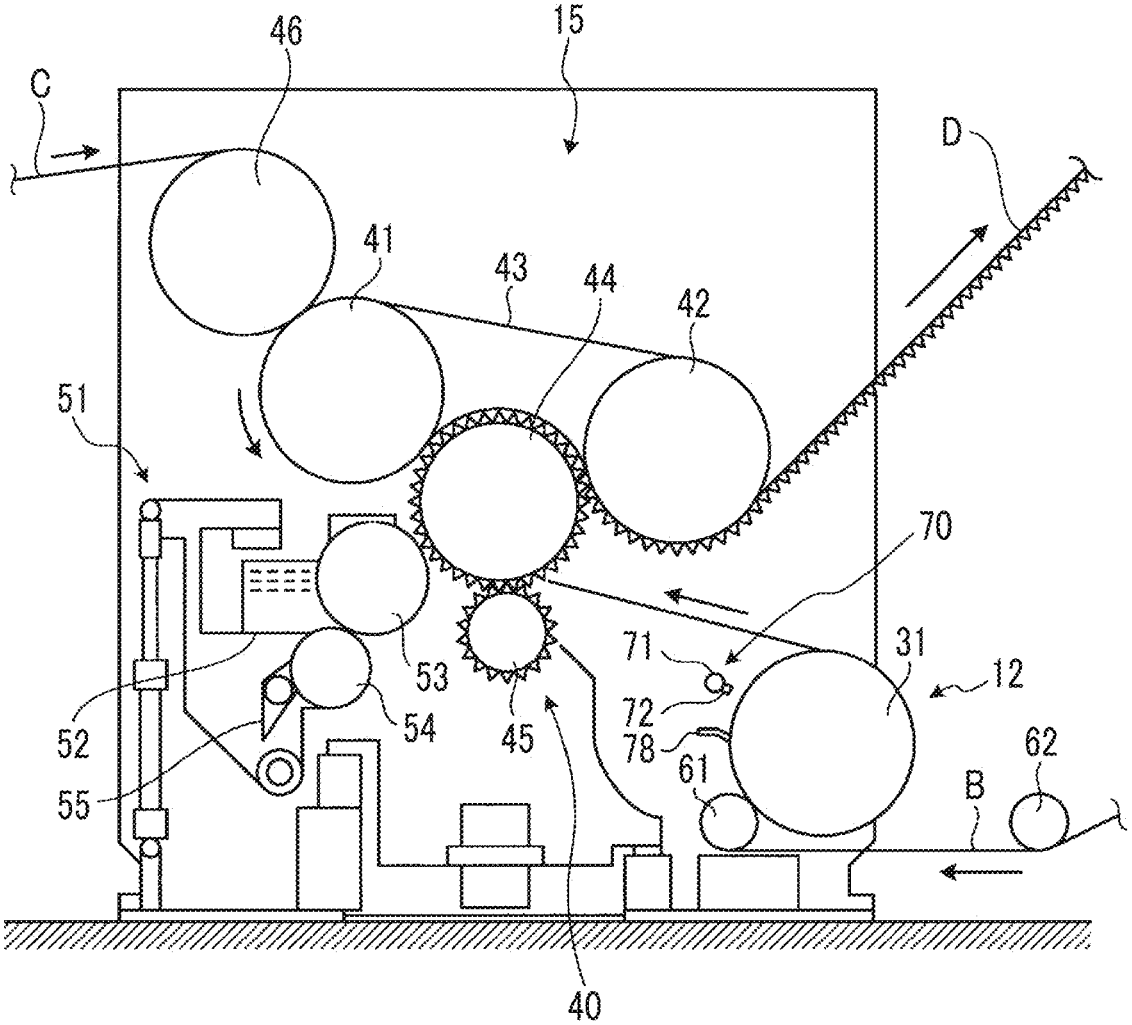
FIG. 2 is a schematic configuration diagram illustrating a single facer.

Here, the single facer 15 will be described in detail. FIG. 2 is a schematic configuration diagram illustrating the single facer.

As illustrated in FIG. 2, the single facer 15 includes a belt roll 41, a tension roll 42, a pressurizing belt 43, an upper corrugating roll 44, and a lower corrugating roll 45.

The belt roll 41 can be driven to rotate by a drive device (not illustrated). The tension roll 42 is rotatably supported at a predetermined interval from the belt roll 41. The pressurizing belt 43 is an endless belt, and is hung between the belt roll 41 and the tension roll 42. The upper corrugating roll 44 can be driven to rotate by a drive device (not illustrated), and the outer peripheral surface is formed in a corrugated shape. The upper corrugating roll 44 is disposed below the pressurizing belt 43 between the belt roll 41 and the tension roll 42, and the corrugated outer peripheral surface abuts on the lower surface of the pressurizing belt 43 in a pressurized state. As in the upper corrugating roll 44, the lower corrugating roll 45 has the outer peripheral surface formed in a corrugated shape, and meshes with the outer peripheral surface of the lower corrugating roll 45 below the lower corrugating roll 45.

Therefore, the top liner C is wrapped around the guide roll 46, and thereafter, is transferred to a nip portion between the pressurizing belt 43 and the upper corrugating roll 44 together with the pressurizing belt 43 guided by the belt roll 41. On the other hand, the medium B is corrugated in a meshing portion between the upper corrugating roll 44 and the lower corrugating roll 45, and thereafter, is guided by the upper corrugating roll 44 to be transferred to the nip portion between the pressurizing belt 43 and the upper corrugating roll 44.

In addition, the single facer 15 includes an adhesive equipment 51. The adhesive equipment 51 is disposed in the vicinity of the upper corrugating roll 44. The adhesive equipment 51 includes an adhesive dam 52, an adhesive applicator roll 53, a meter roll 54, and an adhesive scraping blade 55.

The adhesive dam 52 stores a predetermined amount of the adhesive. The adhesive applicator roll 53 perform gluing by causing the adhesive stored in the adhesive dam to adhere to the medium B transferred by the upper corrugating roll 44. The meter roll 54 comes into contact with the outer peripheral surface of the adhesive applicator roll 53, and synchronously rotates to adjust the amount of the adhesive adhering to the outer peripheral surface of the adhesive applicator roll 53. Since the adhesive scraping blade 55 comes into contact with the outer peripheral surface of the meter roll 54, the adhesive scraping blade 55 removes the adhesive from the adhesive applicator roll 53, and scrapes off the extra adhesive adhering to the outer peripheral surface of the meter roll 54.

Therefore, the adhesive stored in the adhesive dam 52 adheres to the rotating adhesive applicator roll 53, and the amount of the adhesive adhering to the outer peripheral surface is adjusted by the meter roll 54. In the medium B corrugated in the meshing portion between the upper corrugating roll 44 and the lower corrugating roll 45, an adhesive is applied to a top of each stage by the adhesive applicator roll 53. When the medium B subjected to adhesive application is transferred to the nip portion between the pressurizing belt 43 and the upper corrugating roll 44, the medium B adheres to the top liner C to form the single-faced cardboard sheet D.

The belt roll 41, the tension roll 42, the upper corrugating roll 44, and the lower corrugating roll 45 are heated by the internally circulating steam. Therefore, the top liner C is heated when the top liner C comes into contact with the belt roll 41 and the tension roll 42 via the pressurizing belt 43. The medium B is heated when the medium B is pressed and corrugated in the meshing portion between the upper corrugating roll 44 and the lower corrugating roll 45. In addition, the medium B is heated from the meshing portion until the medium B overlaps the top liner C between the pressurizing belt 43 and the upper corrugating roll 44. While being heated, an adhesive is applied to the top of each stage of the medium B by the adhesive applicator roll 53. The medium B is transferred to the nip portion between the pressurizing belt 43 and the upper corrugating roll 44. Here, the top liner C and the medium B are pressurized and joined to each other. The adhesive is solidified by receiving a predetermined amount of heat to increase an adhesive strength, and the medium B and the top liner C are bonded to each other by the adhesive solidified after receiving the heat.

Figure 3:
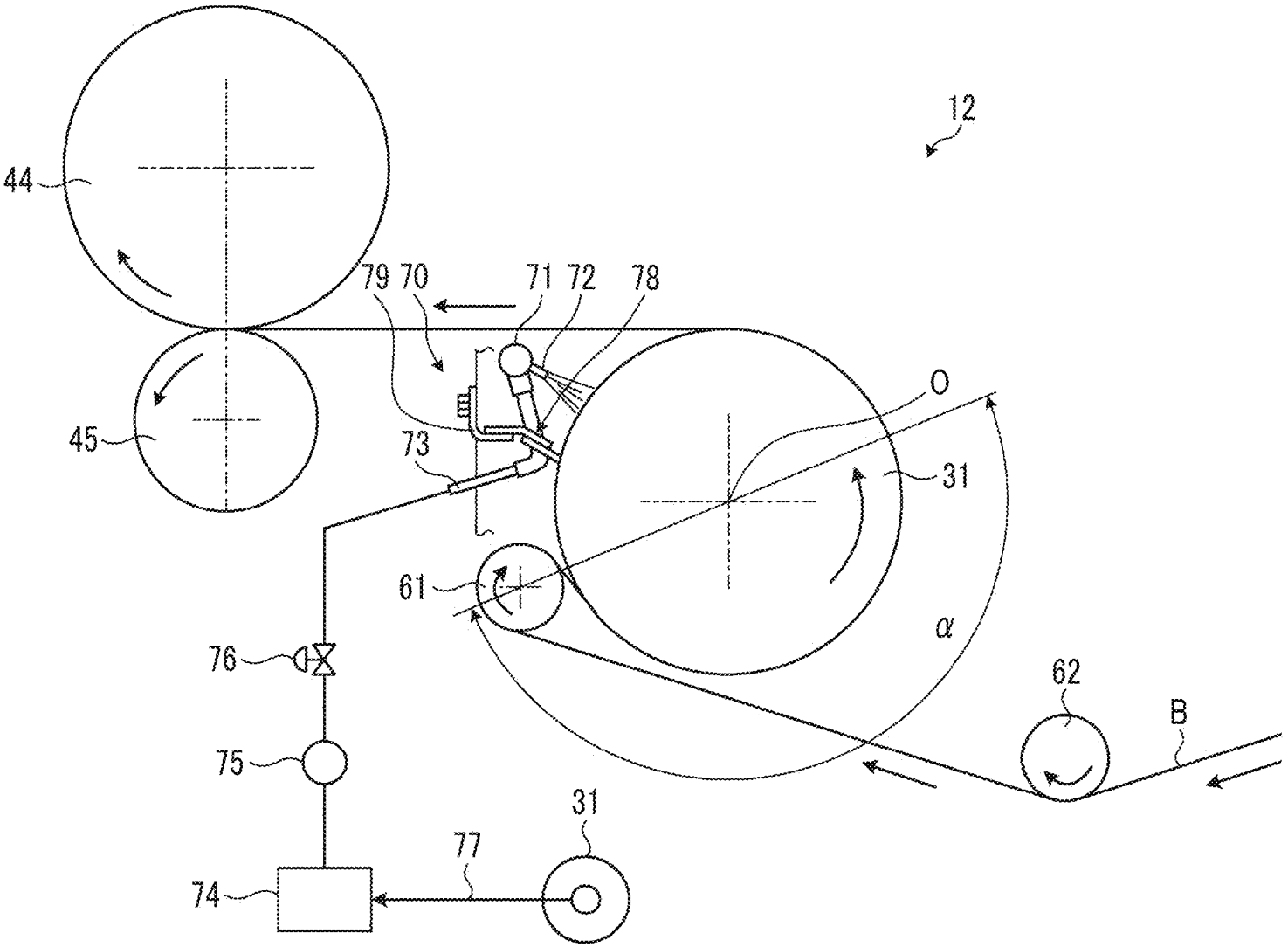
FIG. 3 is a schematic configuration diagram illustrating a sheet humidifying device according to the present embodiment.

Here, the sheet humidifying device of the present embodiment will be described in detail. FIG. 3 is a schematic configuration diagram illustrating the sheet humidifying device of the present embodiment.

The preheater 12 has the preheating roll 31. The medium B is wrapped around the rotating preheating roll 31, and is transferred while being heated. The steam circulates inside the preheating roll 31 to heat the preheating roll 31. Therefore, the medium B is heated when the medium B comes into contact with the preheating roll 31.

The preheater 12 is provided with an angle adjustment roll (sheet wrap angle adjustment roll) 61 that adjusts a contact position where the medium B comes into contact with the outer peripheral surface of the preheating roll 31 from the lower side of the preheating roll 31 in the vertical direction. The angle adjustment roll 61 is rotatable, and can move along the circumferential direction of the preheating roll 31 by a movement unit (not illustrated).

After being wrapped around the guide roller 62, the medium B comes into contact with the outer peripheral surface of the preheating roll 31 from the lower side of the preheating roll 31 in the vertical direction via the angle adjustment roll 61. The medium B is preheated after being wrapped around the outer peripheral surface of the preheating roll 31 by a predetermined length in the circumferential direction. The medium B is transferred to the meshing portion between the upper corrugating roll 44 and the lower corrugating roll 45 to be separated in the horizontal direction from the outer peripheral surface on the upper side of the preheating roll 31 in the vertical direction. Here, the medium B is configured to be separated in the horizontal direction from the outer peripheral surface on the upper side of the preheating roll 31 in the vertical direction. However, the medium B may be configured to be separated obliquely upward from the outer peripheral surface on the upper side of the preheating roll 31 in the vertical direction. Here, the angle adjustment roll 61 is moved along the circumferential direction of the preheating roll 31. In this manner, the contact position between the medium B and the preheating roll 31 is changed. Then, a wrap angle of the medium B wrapped around the preheating roll 31, that is, a wrap length of the medium B wrapped around the preheating roll 31 is changed, and a heating amount of the medium B heated by the preheating roll 31 can be adjusted.

The preheater 12 is provided with a humidifying water ejection device 70 that ejects humidifying water to the outer peripheral surface of the preheating roll 31 around which the medium (sheet) B is not wrapped. As illustrated in FIG. 3, the humidifying water ejection device 70 ejects the humidifying water to the outer peripheral surface of the preheating roll 31 around which the medium B is not wrapped.

The humidifying water ejection device 70 ejects the humidifying water to the outer peripheral surface of the preheating roll 31, from below the medium B separated in the horizontal direction from the preheating roll 31 toward the meshing portion between the upper corrugating roll 44 and the lower corrugating roll 45. The humidifying water ejection device 70 ejects the humidifying water to the outer peripheral surface of the preheating roll 31, from above the angle adjustment roll 61.

A configuration of the humidifying water ejection device 70 will be described in detail. The angle adjustment roll 61 is supported to be movable along the circumferential direction in a predetermined movement range a set in advance, on the outer peripheral side of the preheating roll 31. The humidifying water ejection device 70 is disposed outside the predetermined movement range a of the angle adjustment roll 61. That is, the water supply pipe 71 is provided to face the outer peripheral surface around which the medium B is not wrapped in the preheating roll 31. The water supply pipe 71 is disposed along the axial direction of the preheating roll 31 at a position separated from the outer peripheral surface of the preheating roll 31 by a predetermined distance. The water supply pipe 71 is provided with a plurality of nozzles 72 that eject the humidifying water at a predetermined interval in the longitudinal direction. The plurality of nozzles 72 are provided over an entire region in the width direction of the medium B wrapped around the preheating roll 31, and an ejection direction of the humidifying water is provided to face a rotation center O of the preheating roll 31. It is preferable that an ejection position where the humidifying water is ejected by the plurality of nozzles 72 is close to a position where the medium B comes into contact with the preheating roll 31.

One end portion of the water supply pipe 71 in the longitudinal direction is closed, and one end portion of the connection pipe 73 is connected to the other end portion. The other end portion of the connection pipe 73 is connected to the storage tank 74. The connection pipe 73 is provided with a supply pump 75 and a flow regulation valve (ejection amount adjustment device) 76. Therefore, when the supply pump 75 is driven, the humidifying water of the storage tank 74 is supplied to the water supply pipe 71 via the connection pipe 73, and the plurality of nozzles 72 can eject the humidifying water to the outer peripheral surface around which the medium B is not wrapped in the preheating roll 31. Here, since an opening degree of the flow regulation valve 76 is adjusted, it is possible to adjust the ejection amount of the humidifying water ejected to the outer peripheral surface of the preheating roll 31.

In addition, the humidifying water stored in the storage tank 74 is condensed water of the steam. That is, as described above, the preheating rolls 31, 32, 33, and 34, the belt roll 41, the tension roll 42, the upper corrugating roll 44, and the lower corrugating roll 45 are heated by the internally circulating steam. Then, the condensed water generated by cooling the steam is discharged from the preheating rolls 31, 32, 33, and 34, the belt roll 41, the tension roll 42, the upper corrugating roll 44, and the lower corrugating roll 45. For example, the storage tank 74 is connected to the discharge pipe 77 from the preheating roll 31, and the condensed water generated by heating the preheating roll 31 is supplied.

Incidentally, the humidifying water stored in the storage tank 74 is the condensed water of the steam supplied to the preheating roll 31. Accordingly, the humidifying water is maintained at a predetermined pressure. Therefore, as the humidifying water, the humidifying water ejection device 70 ejects high-pressure hot water (condensed water) having a temperature of 100° C. or higher toward the outer peripheral surface of the preheating roll 31. Then, a portion of the humidifying water ejected from the plurality of nozzles 72 is vaporized into the steam in the atmosphere, and the rest reaches the outer peripheral surface of the preheating roll 31. However, the preheating roll 31 is heated to a high temperature (for example, 150° C.) by the steam. Accordingly, a portion of the humidifying water reaching the outer peripheral surface of the preheating roll 31 is also vaporized into the steam. In this case, the supplied humidifying water is the high-pressure hot water. Accordingly, the humidifying water can be supplied to the outer peripheral surface of the preheating roll 31 without providing the above-described supply pump 75.

The condensed water discharged from the preheating rolls 32, 33, and 34, the belt roll 41, the tension roll 42, the upper corrugating roll 44, and the lower corrugating roll 45 may be stored in the storage tank 74.

In addition, a leveling blade 78 that comes into contact with the outer peripheral surface of the preheating roll 31 is provided on the downstream side in the rotation direction of the preheating roll 31 from the water supply pipe 71 and the plurality of nozzles 72. The leveling blade 78 is attached to a bracket 79 whose base end portion is fixed to a frame of the preheater 12. For example, the leveling blade 78 is configured to include a metal plate fixed to a bracket 79 and a rubber plate or a resin plate fixed to a tip portion of the metal plate, and the tip portion of the rubber plate or the resin plate comes into contact with the outer peripheral surface of the preheating roll 31. Therefore, the humidifying water adhering to the outer peripheral surface of the preheating roll 31 is leveled by the leveling blade 78, and the film thickness is adjusted to be uniform in the axial direction of the preheating roll 31.

Hereinafter, a humidifying method using the sheet humidifying device of the present embodiment will be described in detail.

The medium B is preheated after being wrapped around the outer peripheral surface of the preheating roll 31 by a predetermined length from the guide roller 62 via the angle adjustment roll 61. Thereafter, the medium B is transferred to the meshing portion between the upper corrugating roll 44 and the lower corrugating roll 45 to be separated in the horizontal direction. In this case, the humidifying water ejection device 70 supplies the high-pressure humidifying water to the water supply pipe 71. In this manner, the plurality of nozzles 72 eject the humidifying water toward the outer peripheral surface of the preheating roll 31. Then, the humidifying water is the high-pressure hot water having a temperature of 100° C. or higher. Accordingly, a portion of the humidifying water is vaporized into the steam in the atmosphere, and the rest reaches the outer peripheral surface of the preheating roll 31.

A portion of the humidifying water reaching the outer peripheral surface of the preheating roll 31 is vaporized into the steam by coming into contact with the outer peripheral surface of the high temperature preheating roll 31. The outer peripheral surface of the preheating roll 31 is wetted with the humidifying water or the steam, and the film thickness of the humidifying water is uniformly adjusted in the axial direction of the preheating roll 31 by the leveling blade 78. The medium B comes into contact with the outer peripheral surface of the preheating roll 31 via the angle adjustment roll 61. Accordingly, the medium B is primarily humidified here. For example, the medium B is manufactured from wood fibers, and the surface has an uneven shape. When the medium B comes into contact with the outer peripheral surface of the preheating roll 31 to which the humidifying water adheres, moisture enters an uneven portion of the medium B. Therefore, heat of the preheating roll 31 is transferred to the medium B via the humidifying water, thereby improving thermal conductivity. That is, the heat and the moisture are supplied to the medium B from the preheating roll 31 at the same time.

In addition, the medium B comes into contact with the outer peripheral surface of the preheating roll 31, and thereafter, is separated in the horizontal direction. The steam vaporized when the humidifying water is ejected from the plurality of nozzles 72 rises as it is without being directed to the outer peripheral surface of the preheating roll 31. The medium B is secondarily humidified by the rising steam. In this case, the humidifying water ejected from the plurality of nozzles 72 is ejected to a closed space partitioned by the leveling blade 78, the outer peripheral surface of the preheating roll 31, and the medium B. Accordingly, the generated steam is likely to adhere to the medium B.

As described above, the sheet humidifying device of the present embodiment includes the preheating roll 31 in which the medium B is wrapped around the outer peripheral surface, and the humidifying water ejection device 70 that ejects the humidifying water to the outer peripheral surface around which the medium B is not wrapped in the preheating roll 31.

Therefore, the medium B is heated by being wrapped around the outer peripheral surface of the preheating roll 31. In this case, when the humidifying water ejection device 70 ejects the humidifying water toward the preheating roll 31, the humidifying water adheres to the outer peripheral surface of the preheating roll 31. In this case, a portion of the humidifying water adhering to the outer peripheral surface of the preheating roll 31 is heated to a high temperature, and is supplied to the medium B wrapped via the outer peripheral surface of the preheating roll 31. A portion of the humidifying water is vaporized into the steam by coming into contact with the outer peripheral surface of the preheating roll 31, and the medium B is humidified. That is, the medium B is heated and humidified at the same time. Accordingly, the moisture content amount of the medium B can be properly adjusted. In addition, a simplified device can be achieved since a roll for humidifying the medium B is not separately required.

In the sheet humidifying device of the present embodiment, the medium B comes into contact with the outer peripheral surface of the preheating roll 31 from the lower side of the preheating roll 31 in the vertical direction, and is wrapped around the outer peripheral surface of the preheating roll 31 by a predetermined length in the circumferential direction. Thereafter, the medium B is transferred to be separated from the outer peripheral surface on the upper side in the vertical direction of the preheating roll 31. The humidifying water ejection device 70 ejects the humidifying water to the outer peripheral surface of the preheating roll 31, from below the medium B separated from the preheating roll 31. Therefore, the ejected humidifying water reaches the outer peripheral surface of the preheating roll 31, and is vaporized into the steam by coming into contact with the outer peripheral surface of the preheating roll 31. Accordingly, the medium B is humidified from the outer peripheral surface of the preheating roll 31, and is also humidified by the steam even after the medium B is separated from the outer peripheral surface of the preheating roll 31. Therefore, a sufficient amount for humidifying the medium B can be secured.

In the sheet humidifying device of the present embodiment, the predetermined movement range a set in advance on the outer peripheral side of the preheating roll 31 is supported to be movable along the circumferential direction. The angle adjustment roll 61 that adjusts the sheet contact position for coming into contact with the outer peripheral surface of the preheating roll 31 is provided. The humidifying water ejection device 70 is disposed outside the predetermined movement range a. Therefore, the humidifying water ejection device 70 can eject the humidifying water to the preheating roll 31, and the humidifying water ejection device 70 can efficiently humidify the medium B without disturbing movement adjustment work of the angle adjustment roll 61. The heating amount of the medium B heated by the preheating roll 31 can be preferably adjusted.

In the sheet humidifying device of the present embodiment, the humidifying water ejection device 70 ejects the humidifying water to the outer peripheral surface of the preheating roll 31, from above the angle adjustment roll 61. Accordingly, a position of the humidifying water reaching the preheating roll 31 is brought closer to a position where the medium B comes into contact with the preheating roll 31. Therefore, the humidifying water from the humidifying water ejection device 70 can be efficiently supplied to the medium B.

In the sheet humidifying device of the present embodiment, as the humidifying water, the humidifying water ejection device 70 ejects the high-pressure hot water having a temperature of 100° C. or higher toward the outer peripheral surface of the preheating roll 31. Therefore, a portion of the high-pressure hot water having the temperature of 100°

C. or higher ejected from the humidifying water ejection device is vaporized into the steam in the atmosphere. Accordingly, the medium B can be efficiently humidified not only by the humidifying water but also by the steam.

In the sheet humidifying device of the present embodiment, the preheating roll 31 can heat the medium B wrapped around the outer peripheral surface by supplying the steam into the preheating roll 31. As the humidifying water, the humidifying water ejection device 70 ejects the condensed water of the steam discharged from the preheating roll 31 toward the outer peripheral surface of the preheating roll 31. Accordingly, it is not necessary to separately prepare the humidifying water, and the condensed water can be effectively utilized. Therefore, a cost increase can be suppressed.

In the sheet humidifying device of the present embodiment, the humidifying water ejection device 70 has the flow regulation valve (ejection amount adjustment device) that adjusts the ejection amount of the humidifying water ejected to the outer peripheral surface of the preheating roll 31. A proper amount of the humidifying water can be ejected in accordance with the water content of the medium B to be used.

In the sheet humidifying device of the present embodiment, the humidifying water ejection device 70 has the water supply pipe 71 disposed along the axial direction of the preheating roll 31 at the position separated from the outer peripheral surface of the preheating roll 31, and the plurality of nozzles 72 provided at a predetermined interval in the longitudinal direction of the water supply pipe 71 to eject the humidifying water. The leveling blade 78 that comes into contact with the outer peripheral surface of the preheating roll 31 is provided on the downstream side in the rotation direction of the preheating roll 31 from the plurality of nozzles 72. Therefore, when the humidifying water is ejected to the outer peripheral surface of the preheating roll 31 from the plurality of nozzles 72 in the water supply pipe 71, the leveling blade 78 comes into contact with the outer peripheral surface of the preheating roll 31. Accordingly, the film thickness of the humidifying water adhering to the outer peripheral surface of the preheating roll 31 can be adjusted to be uniform in the axial direction of the preheating roll 31.

In addition, the humidifying method for the medium B of the present embodiment includes step of heating the medium B by wrapping the medium B around the outer peripheral surface of the preheating roll 31, and a step of ejecting the humidifying water having a temperature of 100° C. or higher to the outer peripheral surface of the preheating roll 31 before the medium B is wrapped. Therefore, the medium B is humidified by the steam, and is heated by the preheating roll 31. That is, the medium B is heated and humidified at the same time. Accordingly, the moisture content amount of the medium B can be properly adjusted.

In addition, the cardboard sheet-manufacturing apparatus of the present embodiment includes the single facer 15 that manufactures the single-faced cardboard sheet D by bonding the top liner C to the corrugated medium B, the double facer 20 that manufactures the double-faced cardboard sheet E by bonding the bottom liner A to the medium B side in the single-faced cardboard sheet D, and the sheet humidifying device that humidifies at least one of the medium B, the top liner C, and the bottom liner A.

Therefore, the single facer 15 manufactures the single-faced cardboard sheet D by bonding the top liner C to the corrugated medium B, and the double facer 20 manufactures the double-faced cardboard sheet E by bonding the bottom liner A to the medium B side of the single-faced cardboard sheet D. In this case, the sheet humidifying device heats the medium B, the top liner C, and the bottom liner A by wrapping the medium B, the top liner C, and the bottom liner A around the outer peripheral surface of the preheating roll 31. The medium B, the top liner C, and the bottom liner A are humidified by the humidifying water adhering to the preheating roll 31. That is, the medium B, the top liner C, and the bottom liner A are heated and humidified at the same time. Accordingly, the moisture content amount can be properly adjusted. In addition, a simplified device can be achieved since a humidifying roll is not separately required.

In the above-described embodiment, the humidifying water ejection device 70 is provided with the plurality of nozzles 72 at a predetermined interval in the longitudinal direction of the water supply pipe 71. However, the present invention is not limited to the configuration. For example, the plurality of nozzles 72 may be one or a plurality of slit nozzles formed along the longitudinal direction of the water supply pipe 71. In addition, the width for ejecting the humidifying water may be adjustable in accordance with the width of the applicable medium B.

Figure 4:
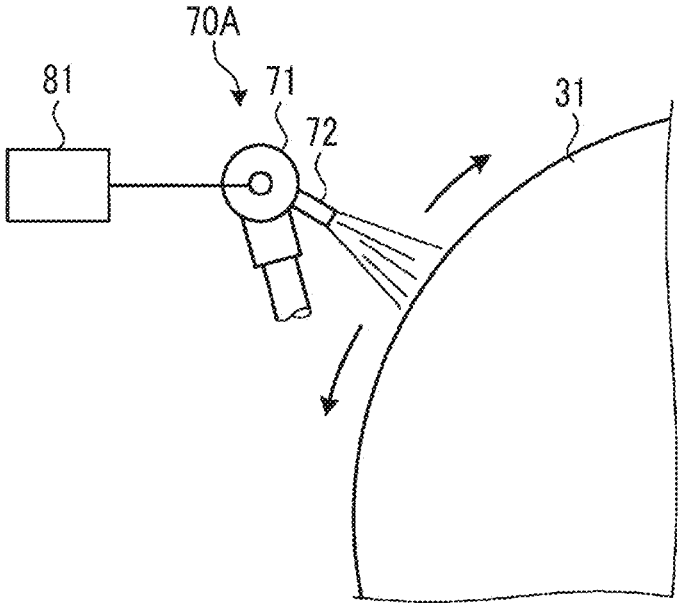
FIG. 4 is a schematic configuration diagram illustrating a first modification example of the sheet humidifying device of the present embodiment.

In addition, in the above-described embodiment, the ejection direction of the humidifying water ejected from the plurality of nozzles 72 in the water supply pipe 71 is fixed. However, the ejection direction may be changeable in accordance with the position of the angle adjustment roll 61. FIG. 4 is a schematic configuration diagram illustrating a first modification example of the sheet humidifying device of the present embodiment. As illustrated in FIG. 4, a nozzle angle adjustment device 81 changes an ejection angle of the plurality of nozzles 72 so that a position of the humidifying water reaching the preheating roll 31 can be adjusted along the circumferential direction of the preheating roll 31. Therefore, a position of the humidifying water reaching the preheating roll 31 can be brought close to a position where the medium B comes into contact with the preheating roll 31. Accordingly, the medium B can be efficiently humidified.

Figure 5:
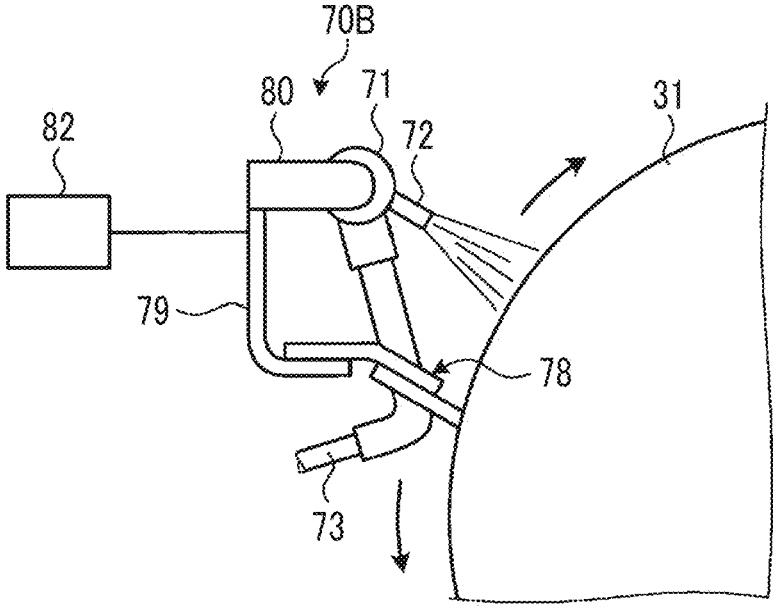
FIG. 5 is a schematic configuration diagram illustrating a second modification example of the sheet humidifying device of the present embodiment.

In addition, in the above-described embodiment, the angle adjustment roll 61 is movable along the circumferential direction of the preheating roll 31. However, the angle adjustment roll 61 may be movable along the circumferential direction of the preheating roll 31 by aligning the water supply pipe 71, the plurality of nozzles 72, and the leveling blade 78 with the angle adjustment roll 61. FIG. 5 is a schematic configuration diagram illustrating a second modification example of the sheet humidifying device of the present embodiment. As illustrated in FIG. 5, the water supply pipe 71, the plurality of nozzles 72, and the bracket 79 supporting the leveling blade 78 are connected by a connection bracket 80. In this manner, the plurality of nozzles 72 and the leveling blade 78 are integrated with each other. The position adjustment device 82 can move and adjust the position of the plurality of nozzles 72 and the leveling blade 78 along the circumferential direction of the preheating roll 31. Therefore, the position of the humidifying water reaching the preheating roll 31 or a leveling position of the humidifying water leveled by the leveling blade 78 can always be brought close to the position where the medium B comes into contact with the preheating roll 31. Accordingly, the medium B can be efficiently humidified.

In addition, in the above-described embodiment, an example has been described in which the sheet humidifying device of the present invention is applied to the preheating roll 31. However, but the sheet humidifying device is also applicable to other preheating rolls 32, 33, and 34.

In addition, in the above-described embodiment, the rotatable preheating rolls 31, 32, 33, and 34 are applied to the embodiment as the heating rolls. However, a configuration may be adopted in which the sheet is guided by being wrapped around the outer peripheral surface without rotating the heating rolls. In this case, a portion of the ejected humidifying water is vaporized into the steam in the atmosphere, and a portion of the humidifying water is vaporized into the steam by coming into contact with the outer peripheral surface of the heating roll. In addition, a portion of the humidifying water reaches the contact position with the sheet along the outer peripheral surface of the heating roll, and the humidifying water is supplied to the sheet. The leveling blade is provided on the lower side in the vertical direction from a supply position of the humidifying water supplied to the heating roll. In this manner, the humidifying water moving along the outer peripheral surface of the heating roll can be leveled.

In addition, in the above-described embodiment, the humidifying water is the high-pressure hot water (condensed water). However, normal temperature water may be used, and warm water (40° C. to 100° C.) is preferably used. In this case, normal temperature water or warm water may be separately prepared and supplied to the nozzle by using a pump.

REFERENCE SIGNS LIST

10: corrugating machine (cardboard sheet-manufacturing apparatus)
11: mill roll stand
12: preheater
13: mill roll stand
14: preheater
15: single facer
16: bridge
17: mill roll stand
18: preheater
19: glue machine
20: double facer
21: rotary shear
22: slitter scorer
23: cutoff
24: defective sheet rejecting device
25: stacker
31, 32, 33, 34: preheating roll (heating roll)
41: belt roll
42: tension roll
43: pressurizing belt
44: upper corrugating roll
45: lower corrugating roll
51: adhesive equipment
61: angle adjustment roll (sheet wrap angle adjustment roll)
62: guide roller
70: humidifying water ejection device
71: water supply pipe
72: nozzle
73: connection pipe
74: storage tank
75: supply pump
76: flow regulation valve (ejection amount adjustment device)
77: discharge pipe
78: blade
79: bracket
80: connection bracket
81: nozzle angle adjustment device
82: Position adjustment device
A: bottom liner (first liner)
B: medium
C: top liner (second liner)
D: single-faced cardboard sheet
E: double-faced cardboard sheet
F: double-faced cardboard sheet

The invention claimed is:

1. A sheet humidifying device comprising:
a heating roll having an outer peripheral surface around which a sheet is wrapped; and
a humidifying water ejection device that ejects humidifying water to the outer peripheral surface around which the sheet is not wrapped in the heating roll,
wherein the heating roll is capable of heating the sheet wrapped around the outer peripheral surface by supplying steam into the heating roll, and
the humidifying water ejection device ejects condensed water of the steam discharged from the heating roll, toward the outer peripheral surface of the heating roll.

2. The sheet humidifying device according to claim 1,
wherein the sheet comes into contact with the outer peripheral surface of the heating roll from a lower side of the heating roll in a vertical direction, is wrapped around the outer peripheral surface of the heating roll by a predetermined length in a circumferential direction, and thereafter, is conveyed to be separated from the outer peripheral surface on an upper side of the heating roll in the vertical direction, and
the humidifying water ejection device ejects the humidifying water to the outer peripheral surface of the heating roll, from below the sheet separated from the heating roll.

3. The sheet humidifying device according to claim 1, further comprising:
a sheet wrap angle adjustment roll supported to be movable along a circumferential direction in a predetermined movement range set in advance on an outer peripheral side of the heating roll, and adjusting a sheet contact position for coming into contact with the outer peripheral surface of the heating roll,
wherein the humidifying water ejection device is disposed outside the predetermined movement range.

4. The sheet humidifying device according to claim 3,
wherein the humidifying water ejection device ejects the humidifying water to the outer peripheral surface of the heating roll, from above the sheet wrap angle adjustment roll.

5. The sheet humidifying device according to claim 1,
wherein as the humidifying water, the humidifying water ejection device ejects high-pressure hot water having a temperature of 100° C. or higher toward the outer peripheral surface of the heating roll.

6. The sheet humidifying device according to claim 1,
wherein the humidifying water ejection device has an ejection amount adjustment device that adjusts an ejection amount of the humidifying water ejected to the outer peripheral surface of the heating roll.

7. The sheet humidifying device according to claim 1,
wherein the humidifying water ejection device has a water supply pipe disposed along an axial direction of the heating roll at a position separated from the outer peripheral surface of the heating roll, and a plurality of nozzles provided at a predetermined interval in a longitudinal direction of the water supply pipe, and ejecting the humidifying water, and the humidifying water ejection device is provided with a leveling blade that comes into contact with the outer peripheral surface of the heating roll.

8. A cardboard sheet-manufacturing apparatus comprising:

a single facer that manufactures a single-faced cardboard sheet by bonding a second liner to a corrugated medium;

a double facer that manufactures a cardboard sheet by bonding a first liner to the medium side in the single-faced cardboard sheet; and the sheet humidifying device according to claim 1, which humidifies at least one of the medium, the second liner, and the first liner.

9. A sheet humidifying method comprising:

a step of heating a sheet by wrapping the sheet around an outer peripheral surface of a heating roll; and a step of ejecting humidifying water having a temperature of 1000 C or higher to the outer peripheral surface of the heating roll around which the sheet is not wrapped, wherein the heating roll is capable of heating the sheet wrapped around the outer peripheral surface by supplying steam into the heating roll, and in the step of ejecting humidifying water, condensed water of the steam discharged from the heating roll is ejected toward the outer peripheral surface of the heating roll.

* * * * *